US009596895B2

(12) United States Patent
Meraz

(10) Patent No.: US 9,596,895 B2
(45) Date of Patent: Mar. 21, 2017

(54) PAINT SUIT

(71) Applicant: Ricardo Meraz, Oceanside, CA (US)

(72) Inventor: Ricardo Meraz, Oceanside, CA (US)

( * ) Notice: Subject to any disclaimer, the term of this patent is extended or adjusted under 35 U.S.C. 154(b) by 0 days.

(21) Appl. No.: 13/646,437

(22) Filed: Oct. 5, 2012

(65) Prior Publication Data

US 2014/0096299 A1 Apr. 10, 2014

(51) Int. Cl.

| | |
|---|---|
| ***A41D 27/28*** | (2006.01) |
| ***A41D 13/02*** | (2006.01) |
| *A41D 13/06* | (2006.01) |

(52) U.S. Cl.

CPC ..... *A41D 13/02* (2013.01); *A41D 13/065* (2013.01); *A41D 27/28* (2013.01); *A41D 2600/20* (2013.01)

(58) Field of Classification Search

CPC .... A41D 15/00; A41D 13/0015; A41D 13/02; A41D 1/06; A62B 17/006

USPC ..... 2/70, 901, 79, 227, 69

See application file for complete search history.

(56) References Cited

U.S. PATENT DOCUMENTS

| | | | | | |
|---|---|---|---|---|---|
| 3,921,224 | A * | 11/1975 | Ingram, III | 2/93 |
| 4,561,124 | A * | 12/1985 | Thompson | 2/23 |
| 4,860,382 | A * | 8/1989 | Markwell | 2/457 |
| 4,920,575 | A * | 5/1990 | Bartasis et al. | 2/457 |
| 4,922,551 | A * | 5/1990 | Anthes | 2/79 |
| 4,932,078 | A * | 6/1990 | Jones et al. | 2/70 |
| 5,038,408 | A * | 8/1991 | DeBaene | 2/23 |
| 5,410,758 | A * | 5/1995 | Dupont et al. | 2/51 |
| 5,511,246 | A * | 4/1996 | Farkas et al. | 2/79 |
| 5,555,561 | A * | 9/1996 | Plachta et al. | 2/457 |
| 5,652,966 | A * | 8/1997 | Reinert, Sr. | 2/457 |
| 5,784,717 | A * | 7/1998 | Singer | 2/79 |
| 5,991,921 | A * | 11/1999 | Saito | 2/69 |
| 6,047,413 | A * | 4/2000 | Welchel et al. | 2/457 |
| 6,286,144 | B1 * | 9/2001 | Henderson et al. | 2/69 |
| 6,854,135 | B2 * | 2/2005 | Jones et al. | 2/456 |
| 6,941,584 | B1 * | 9/2005 | Matthews | 2/234 |
| 7,203,974 | B2 * | 4/2007 | Jones et al. | 2/456 |
| 7,971,270 | B2 * | 7/2011 | Cox et al. | 2/69 |
| 2004/0006815 | A1 * | 1/2004 | Carroll et al. | 2/457 |
| 2004/0216213 | A1 * | 11/2004 | Paciorkowski | 2/69 |
| 2009/0222974 | A1 * | 9/2009 | Walburg | 2/234 |
| 2009/0235439 | A1 * | 9/2009 | Cox et al. | 2/457 |
| 2011/0203025 | A1 * | 8/2011 | Cannon | 2/2.15 |
| 2012/0131734 | A1 * | 5/2012 | Sindicich | 2/458 |
| 2012/0210499 | A1 * | 8/2012 | Habash | A41D 27/28 2/456 |

* cited by examiner

*Primary Examiner* — Richale Quinn

(74) *Attorney, Agent, or Firm* — John R. Ross; John R. Ross, III

(57) ABSTRACT

A paint suit. A hood is attached to the top of the suit. An elastic waistband and two elastic sleeves are also attached. A central vertical hook-and-loop fastener secures the paint suit onto the wearer. The paint suit includes a breast pocket and preferably four lower pockets. Two knee pads are built into the paint suit. The paint suit also includes two arm pit vents and a back vent.

11 Claims, 3 Drawing Sheets

PAINT SUIT

This application claims the benefit of Provisional Application 61/543,313 filed Oct. 5, 2011, which is incorporated by reference herein. The present invention relates to protective clothing, and in particular, to protective clothing to be worn while painting.

BACKGROUND OF INVENTION

Prior art paint suits are known. For example SAS-Moonsuit (provided by the SAS Safety Corporation) is a prior art suit zipper suit utilized by automobile painters. Also, the Shoot Suit (available from Shoot Suit, Inc.) is a prior art suit with limited features.

Prior art paint suits are limited in the features they offer. They tend to be hot, uncomfortable, expensive and they have no feature to help protect the knees of the painter. Also, they tend to break down quickly so that they must be discarded after minimum usage.

Ripstop is a nylon fabric that is sewn so that a tear or rip will not spread.

Foam rubber knee pads are known and are commonly work by football players for padding in their football pants.

What is needed is a better automotive paint suit.

SUMMARY OF THE INVENTION

The present invention provides a paint suit. A hood is attached to the top of the suit. An elastic waistband and two elastic sleeves are also attached. A central vertical hook-and-loop fastener secures the paint suit onto the wearer. The paint suit includes a breast pocket and preferably four lower pockets. Two knee pads are built into the paint suit. The paint suit also includes two arm pit vents and a back vent.

DETAILED DESCRIPTION OF THE PREFERRED EMBODIMENTS

Figure 1:
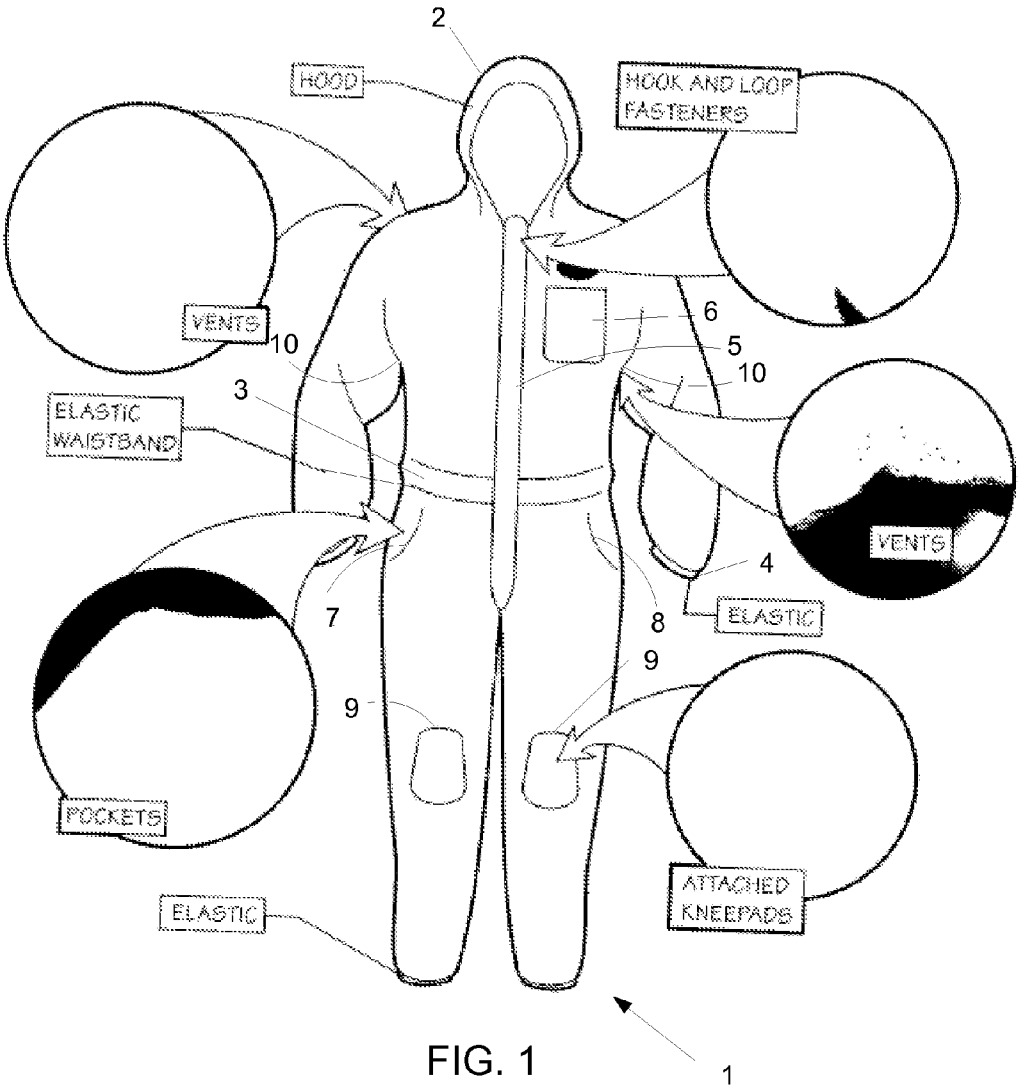
FIGS. 1-2 show a front view of a preferred embodiment of the present invention.
Figure 2:
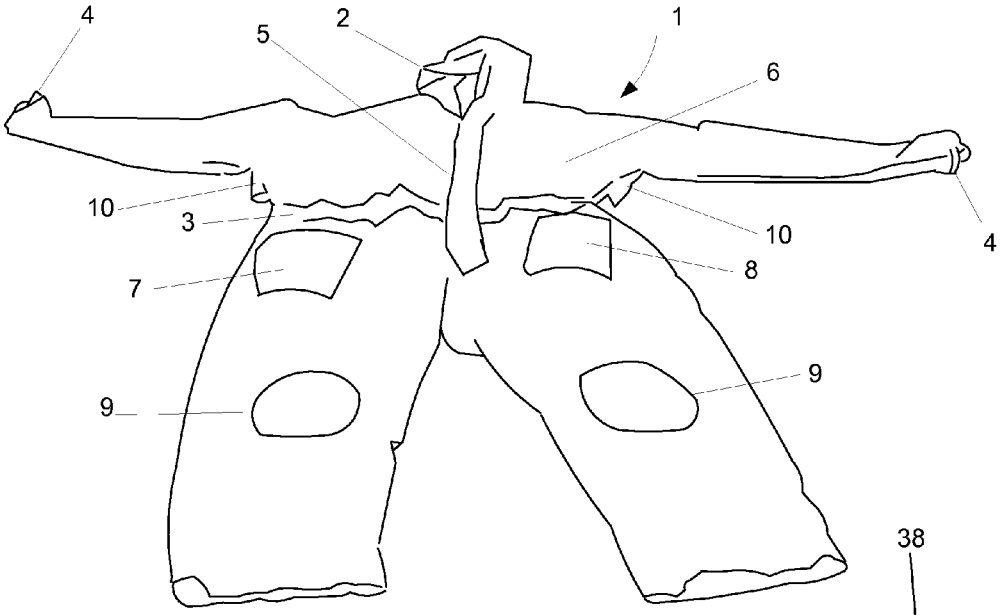
Figure 3B:
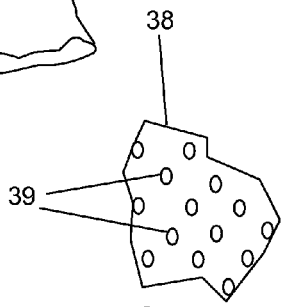
FIG. 3B shows a close up view of a preferred mesh fabric.
Figure 3:
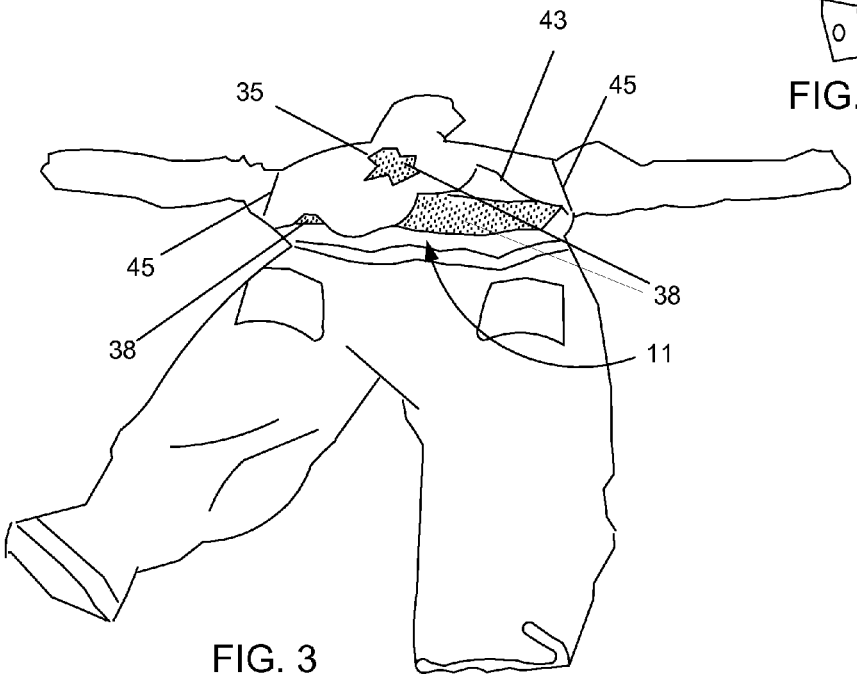
FIG. 3 shows a back view of a preferred embodiment of the present invention.

FIGS. 1-3 show a preferred embodiment of the present invention. Paint suit 1 is a protective overall suit preferably worn by painters (such as automobile painters). Suit 1 is preferably fabricated from ripstop nylon or anti-static polyester. Suit 1 includes attached hood 2, elastic waistband 3, and elastic sleeve bands 4. Suit 1 is secured closed by utilization of a central, vertical hook-and-loop fastener 5, such as Velcro®. Easy access pocket 6 is located at a position adjacent the upper left breast. Lower pockets 7 and 8 are located near waistband 3. Preferably pockets 6, 7 and 8 are secured shut via hook-and-loop fasteners. Knee pads 9 are preferably fabricated from foam rubber and are sewn into suit 1 and provide protection to the user's knees. Arm pit vents 10 provide ventilation for the user's arm pits. Back vent 11 (see FIG. 3) provides ventilation for the user's back.

Attached Hood

Attached hood 2 is sewn to the top of paint suit 1 and protects the painter's head.

Elastic Waistband

Elastic waistband 3 is sewn into the waist of paint suit 1 and functions to hold the paint suit snuggly against the body of the painter.

Elastic Sleeve Bands

Elastic sleeve band 4 are sewn at the ends of the arms of paint suit 1. They function to keep paint and other debris out of the inside of the paint suit.

Hook-and-Loop Fastener

Velcro® hook-and-loop fastener 5 is located at the front of paint suit 1 and allows for easy securing of the suit onto the painter's body.

Pockets

Paint suit 1 includes many pockets 5-8. The pockets allow the painter to store important items such as his wallet or keys.

Ventilation

Back Ventilation

Paint suit 1 has excellent ventilation so that the painter is always kept cool while working. Back vent 11 is shown in FIG. 3. For the purpose of illustration paint suit 1 (FIG. 3) is shown so with a cutout portion 35 so that it can be sent that polyester mesh fabric 38 extends up the wearer's back. Back ventilation cover piece 43 is sewn to paint suit 1 along its sides 45, but is left open along its bottom edge so that air can get to mesh fabric 38. This allows for optimum ventilation and cooling of the painter. FIG. 3B shows a close up view of polyester mesh fabric 38 having multiple ventilation holes 39.

Arm Pit Ventilation

Figure 4:
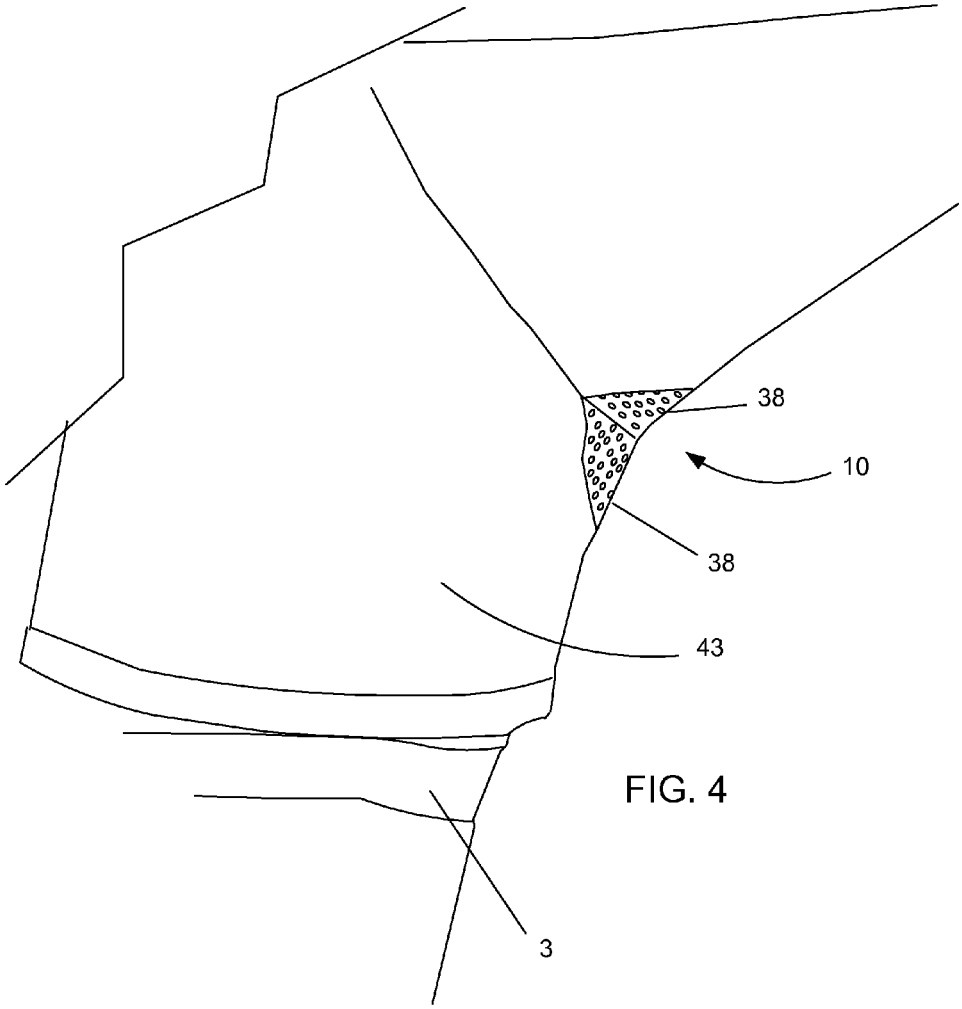
FIG. 4 shows a close up view of the armpit area of a preferred embodiment of the present invention.

FIG. 4 shows a close up view of a preferred armpit vents 10. In a preferred embodiment polyester mesh fabric 38 is sewn to the armpit area of paint suit 1. This allows for good ventilation to the painter so that he remains cool.

Knee Pads

A key component of the present invention are knee pads 9 (FIG. 1, FIG. 2). Knee pads 9 are preferably fabricated from foam rubber and are sewn into paint suit 1 as shown. The utilization of knee pads 1 provides a high level of comfort to the user.

The combined features of the present invention provide for a vast improvement over the prior art. Paint suit 1 is high quality, affordable and provides for outstanding ventilation and comfort. Specifically, knee pads 9 provide for great comfort to the wearer of the suit.

Also, central, vertical hook-and-loop fastener 5 is a vast improvement over the prior art zipper fasteners. Prior art zippers can easily become fouled or damaged, thereby rendering the entire suit useless.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A paint suit, comprising:

A. a torso portion, comprising:

i. a front side, and ii. a back side,

B. two legs connected to said torso portion,

C. two arms connected to said torso portion, each of said two arms further comprising sleeve ends, D. an attached hood connected to said torso portion, E. an elastic waistband connected between said torso portion and said two legs, F. two elastic sleeve bands connected at said sleeve ends of each of said two arms, G. a central vertical hook-and loop fastener connected onto said front side of said torso section for securing the paint suit onto the wearer, H. at least one breast pocket connected onto said torso section, said at least one breast pocket comprising a hook-and loop fastener for securing said at least one breast pocket, I. four lower pockets connected onto said two legs, at least one of said four lower pockets comprising a hook-and loop fastener for securing said at least one lower pocket, J. two knee pads fabricated from rubber foam and sewn into said two legs, K. two arm pit vents connected between said two arms and said torso section, wherein said two arm pit vents are fabricated from mesh fabric and L. a back vent connected onto said back side of said torso section, said back vent comprising:

i. mesh fabric sewn into said paint suit and extending up the back of the said paint suit adapted to fully cover the wearer's back, ii. a back ventilation cover piece sewn into said paint suit and covering said mesh fabric, wherein said back ventilation piece includes a bottom end not attached to said paint suit to allow unrestricted air flow to said mesh fabric, wherein said mesh fabric and said back ventilation cover piece extend to sides located at the beginning of said two arms so that said mesh fabric is adapted to fully cover the wearer's back, and M. wherein said paint suit is fabricated from ripstop nylon.

2. The paint suit as in claim 1, ripstop nylon is anti-static polyester.

3. A paint suit comprising:

A. a torso portion comprising a front side and a back side,

B. two legs connected to said torso portion,

C. two arms connected to said torso portion, each of said two arms further comprising sleeve ends, D. an attached hood connected to said torso portion, E. an elastic waistband connected between said torso portion and said two legs, F. two elastic sleeve bands connected at said sleeve ends of each of said two arms, G. a central vertical hook-and loop fastener connected onto said front side of said torso section for securing the paint suit onto the wearer, H. at least one breast pocket connected onto said torso section, I. at least one lower pocket connected onto at least one of said two legs, J. two knee pads built into said two legs, K. two arm pit vents connected between said two arms and said torso section, and L. a back vent connected onto said back side of said torso section, said back vent comprising:

i. mesh fabric sewn into said paint suit and extending up the back of the said paint suit and adapted to fully cover the wearer's back, and ii. a back ventilation cover piece sewn into said paint suit and covering said mesh fabric, wherein said back ventilation piece includes a bottom end not attached to said paint suit to allow unrestricted air flow to said mesh fabric, wherein said mesh fabric and said back ventilation cover piece extend to sides located at the beginning of said two arms to fully cover the back from arm to arm.

4. The paint suit as in claim 3, wherein said at least one breast pocket comprises a hook-and loop fastener for securing said at least one breast pocket.

5. The paint suit as in claim 3, wherein said at least one lower pocket comprises a hook-and loop fastener for securing said at least one lower pocket.

6. The paint suit as in claim 5, wherein said at least one lower pocket is four lower pockets.

7. The paint suit as in claim 3, wherein said two knee pads are fabricated from rubber foam.

8. The paint suit as in claim 3, wherein said two knee pads are sewn into said paint suit.

9. The paint suit as in claim 3, wherein said two arm pit vents are fabricated from mesh fabric.

10. The paint suit as in claim 3, wherein said paint suit is fabricated from ripstop nylon.

11. The paint suit as in claim 3, wherein said paint suit is fabricated from anti-static polyester.

* * * * *